US006646495B2

(12) United States Patent
Perez

(10) Patent No.: US 6,646,495 B2
(45) Date of Patent: Nov. 11, 2003

(54) THRESHOLD VOLTAGE ADJUSTMENT SCHEME FOR INCREASED OUTPUT SWING

(75) Inventor: Raul A. Perez, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/038,997

(22) Filed: Dec. 31, 2001

(65) Prior Publication Data

US 2003/0122613 A1 Jul. 3, 2003

(51) Int. Cl.[7] ..... G05F 1/46; G05F 1/44
(52) U.S. Cl. ..... 327/541; 327/543; 323/274
(58) Field of Search ..... 327/540, 541, 327/543; 323/274, 275, 276, 277, 303

(56) References Cited

U.S. PATENT DOCUMENTS 5,804,958 A * 9/1998 Tsui et al. ..... 323/313
6,140,805 A * 10/2000 Kaneko et al. ..... 323/280
6,188,212 B1 * 2/2001 Larson et al. ..... 323/281
6,448,750 B1 * 9/2002 Shor et al. ..... 323/282

* cited by examiner

*Primary Examiner*—Timothy P. Callahan
*Assistant Examiner*—Terry L. Englund
(74) *Attorney, Agent, or Firm*—Ronald O. Neerings; Wade James Brady, III; Frederick J. Telecky, Jr.

(57) ABSTRACT

The present invention provides increased output swing by connecting a buffer backgate to an upper rail potential (125) during the no load current condition. This can be done through the use of a comparator (440) and a multiplexer (460), thereby changing the threshold voltage of the buffer (115).

20 Claims, 3 Drawing Sheets

UPPER RAIL VOLTAGE
100
115
125
120
110
OUT
PMOS PASS DEVICE
105
V2
NMOS SOURCE FOLLOWER
117
135
R1
130
132
134
R2
140
C1
I1
160
GND
FEEDBACK RESISTORS
150

200
125
UPPER RAIL VOLTAGE

117
PMOS PASS DEVICE
120
215
NMOS SOURCE FOLLOWER
INPUT STAGE
115
135
210
C1
140
220
I2
CONSTANT CURRENT SOURCE
GND

THRESHOLD VOLTAGE ADJUSTMENT SCHEME FOR INCREASED OUTPUT SWING

FIELD OF THE INVENTION

The invention relates generally to voltage regulators and, more particularly, to a threshold voltage adjustment scheme for increased output swing.

BACKGROUND OF THE INVENTION

Certain circuits require an output stage that can go very close to the upper rail voltage while maintaining low impedance. The source follower is an obvious choice to meet the low impedance requirement. Ideally, a natural NMOS device would be the best choice for these kinds of output stages in order to maximize the output swing. But when a particular process does not contain natural devices, designers are only left with the next best choice: low-$V_t$ MOS devices. When used in an output stage, these low-$V_t$, devices can pose a significant problem in meeting the output swing requirements at some process corners.

An example of a circuit that needs a low input and high output swing output stage is a low drop-out (LDO) voltage regulator with an NMOS buffer driving the gate of a PMOS pass device. One such PMOS LDO 100 is illustrated in FIG. 1. Voltage 105 (V2) is supplied to the non-inverting input of amplifier 110. Amplifier 110 receives operational power from the upper rail voltage at node 125 and also receives, at its inverting input, a voltage produced at node 130 between series-connected resistors 132 (R1) and 134 (R2). R1 132 and R2 134 are collectively referenced as feedback resistors 150. Amplifier 110 has an output coupled to the gate of NMOS source follower 115. Both the source and backgate of NMOS source follower 115 are tied to node 117. Node 117 is also tied to the gate of PMOS pass device 120. The drain of NMOS source follower 115 and both the source and backgate of PMOS pass device 120 are tied to the upper rail voltage at node 125. Feedback resistors 150 couple the drain of PMOS pass device 120 at node 135 to the ground supply voltage source. Capacitor 140 (C1) is tied from node 135 to ground. Low impedance is needed for the compensation of LDO 100. PMOS pass device 120 is a very large transistor that will provide current 160 (I1) to a load connected to the output of LDO 100 at node 135. C1 140 also at node 135, on the order of $\mu$F, is used for the compensation of LDO 100.

When the circuit(s) connected to LDO 100 are not pulling any load current I1 160, PMOS pass device 120 has to be completely turned off. This requires NMOS source follower 115 in the output stage to drive the gate voltage of PMOS pass device 120 very close to the upper rail voltage at node 125 in order to reduce the $V_{gst}$ of PMOS pass device 120. Under certain process comers, where NMOS devices are weak, NMOS source follower 115 might not be able to drive the gate of PMOS pass device 120 to a high enough voltage. When this happens, PMOS pass device 120 is in the subthreshold region. Because PMOS pass device 120 is large, it can conduct significant amounts of current I1 160. This current I1 160 will cause a charge to build up in C1 140. This will cause node 135 to start charging towards the upper rail voltage at node 125. The circuitry connected to node 135 will be exposed to this higher voltage. This condition is not acceptable because the maximum voltage ratings in the circuits connected to node 135 might be exceeded. To prevent PMOS pass device 120 from conducting, the $V_{gst}$ of NMOS source follower 115 needs to be lowered to enable it to reach a high enough voltage to completely turn off PMOS pass device 120.

Prior art has attempted to resolve this problem in various ways. One method is to decrease the feedback resistance of feedback resistors 150 in order to increase the current that feedback resistors 150 pull from PMOS pass device 120 during the no load condition. This makes the required output voltage swing smaller for NMOS source follower 115 because PMOS pass device 120 is operating under a higher $V_{gs}$ at the no load condition. But, since PMOS pass device 120 is in the subthreshold region, it follows an exponential current versus $V_{gs}$ relation. This implies that to obtain a small amount of $V_{gs}$ change, a large amount of current is needed. Therefore, the no load quiescent current of the regulator would increase substantially.

A second prior art approach is to maintain a constant current source connected to the output, node 135, of PMOS pass device 120. FIG. 2 diagrammatically illustrates a PMOS LDO 200 implementing this approach. Input stage 210 and cascoded device 215 drive the gate of NMOS source follower 115. Both the source and backgate of NMOS source follower 115 are tied to node 117. Node 117 is also tied to the gate of PMOS pass device 120. The drain of NMOS source follower 115 and both the source and backgate of PMOS pass device 120 are tied to the upper rail voltage at node 125. Capacitor 140 (C1) is tied from node 135 to ground. Constant current source 220 is tied across C1 140. Under the no load condition, constant current source 220 will discharge the leakage current of PMOS pass device 120. But it will also eventually discharge C1 140, causing the output voltage to slowly decay.

Another prior art solution increases the $V_t$ of PMOS pass device 120 by connecting it to a higher potential than the upper rail potential at node 125. This causes the $V_t$ of PMOS pass device 120 to increase due to the body effect. By increasing the $V_t$, PMOS pass device 120 leakage is eliminated, preventing the output from drifting up. However, to obtain the higher voltage required for the backgate, a charge pump circuit must be used. FIG. 3 diagrammatically illustrates a PMOS LDO 300 implementing this approach. Input stage 210 and cascoded device 215 drive the gate of NMOS source follower 115. Both the source and backgate of NMOS source follower 115 are tied to node 117. Node 117 is also tied to the gate of PMOS pass device 120. The drain of NMOS source follower 115 and the source of PMOS pass device 120 are tied to the upper rail voltage at node 125. Capacitor 140 (C1) is tied from the drain of PMOS pass device 120 to ground. The backgate of PMOS pass device 120 is coupled to the output of charge pump 330. The input of charge pump 330 is tied to the upper rail voltage at node 125. This circuit requires a capacitor for each of its stages, thereby consuming a great deal of die area. Furthermore, this prior art solution introduces additional noise because it switches at a fixed frequency. In order to avoid operating charge pump 330 at the regulator's bandwidth, it must operate at a higher frequency, resulting in increased power consumption because the power in charge pump 330 varies linearly with the frequency.

An additional prior art approach is the use of rail to rail common source output stages. This approach, however, does not provide the needed low impedance. This, in turn, degrades the power supply rejection ratio (PSRR) because of the bandwidth reduction.

It is therefore desirable to provide a solution that maintains a constant voltage and a low impedance and does not sacrifice significant amounts of quiescent current or die area. It is also desirable that no additional source of noise be introduced or increased power consumption occur. The present invention provides this by connecting the buffer backgate to the upper rail potential during the no load current condition, thereby changing the threshold voltage of the buffer.

BRIEF DESCRIPTION OF THE DRAWINGS

The above and further advantages of the invention may be better understood by referring to the following description in conjunction with the accompanying drawings in which corresponding numerals in the different figures refer to the corresponding parts, in which.

DETAILED DESCRIPTION

While the making and using of various embodiments of the present invention are discussed herein in terms of current and voltage control through the use low drop-out (LDO) voltage regulators and specific transistors, it should be appreciated that the present invention provides many inventive concepts that can be embodied in a wide variety of contexts. The specific embodiments discussed herein are merely illustrative of specific ways to make and use the invention, and are not meant to limit the scope of the invention.

The present invention provides increased output swing by connecting the buffer backgate to the upper rail potential during the no load current condition through the use of a comparator and a multiplexer, thereby changing the threshold voltage of the buffer. The method and apparatus of the present invention maintain a low impedance and do not sacrifice significant amounts of quiescent current or die area. The present invention does not introduce any additional source of noise or increase the power consumption.

By connecting the backgate of an NMOS buffer to the upper rail potential during the no load current condition, the $V_t$, or threshold voltage, of the NMOS buffer will be changed. The equation for the $V_t$ of a MOS device is:

$$V_t=V_{t0}+\gamma[\sqrt{2\Phi+V_{SB}}-\sqrt{2\Phi}]$$

From this equation, it can be inferred that having a negative $V_{SB}$ (bulk to source voltage) will decrease the threshold voltage of the MOS device. This is because the $V_{SB}$ voltage will be subtracted from $2\phi$, which is two (2) times the Fermi level term. The risk of doing this is that, if the negative $V_{SB}$ is too great, there will be significant forward conduction through the diode formed by the source-backgatejunction. This conduction will follow the equation of the diode:

$$I_d=I_S{*}e^{V^d/V^T}$$

Assuming an $I_s$ of $1e^{-15}$, at room temperature with a forward bias voltage of about 400 mV, the resulting current is approximately 48 nA. This amount of current is insignificant. The 400 mV difference from the upper rail can be safely taken as a reference point for triggering the connection of the backgate to the upper rail potential, thereby obtaining a reduction in the $V_t$ of the buffer without causing any significant forward bias conduction of the source-bulk junction. Therefore, it is safe to assume that if the voltage at the source is within 400 mV of the upper rail, the backgate of the buffer can be connected to the upper rail potential. Other reference voltages can be chosen at higher leakages. This approach provides the extra output swing needed to completely deactivate pass device 120. During normal operation, the backgate of the buffer will be connected to its source. When the reference voltage is reached, the backgate will be connected to the upper rail potential.

Figure 1:
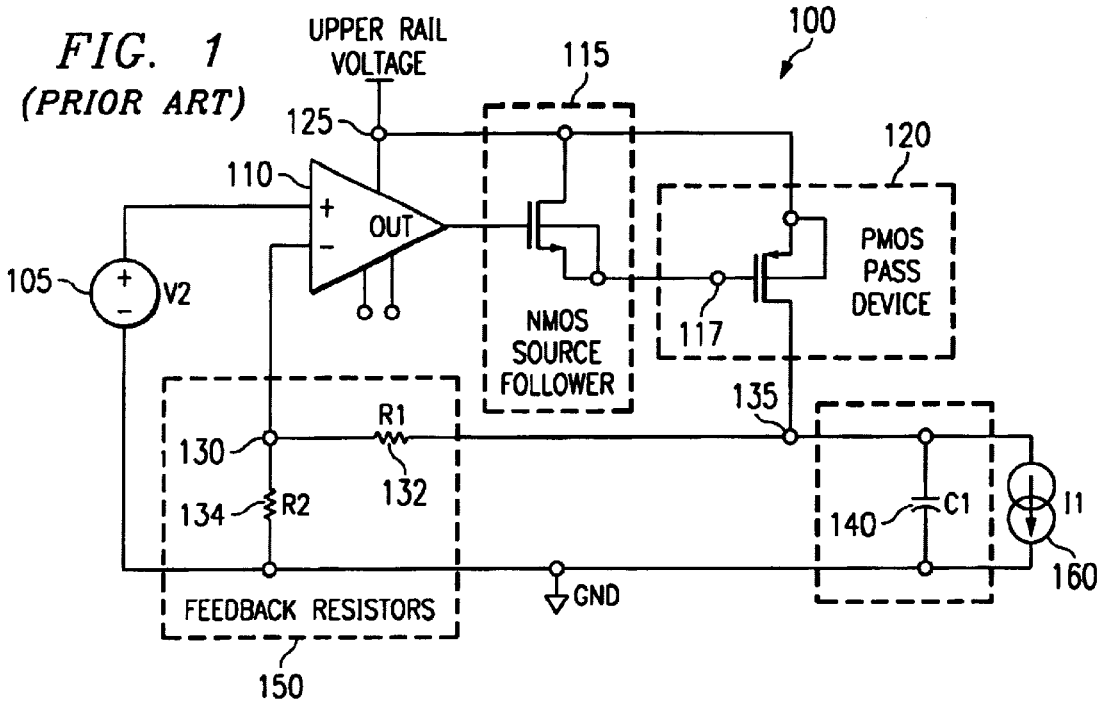
FIG. 1 (PRIOR ART)
FIG. 1 diagrammatically illustrates a PMOS LDO in accordance with the prior art.
Figure 2:
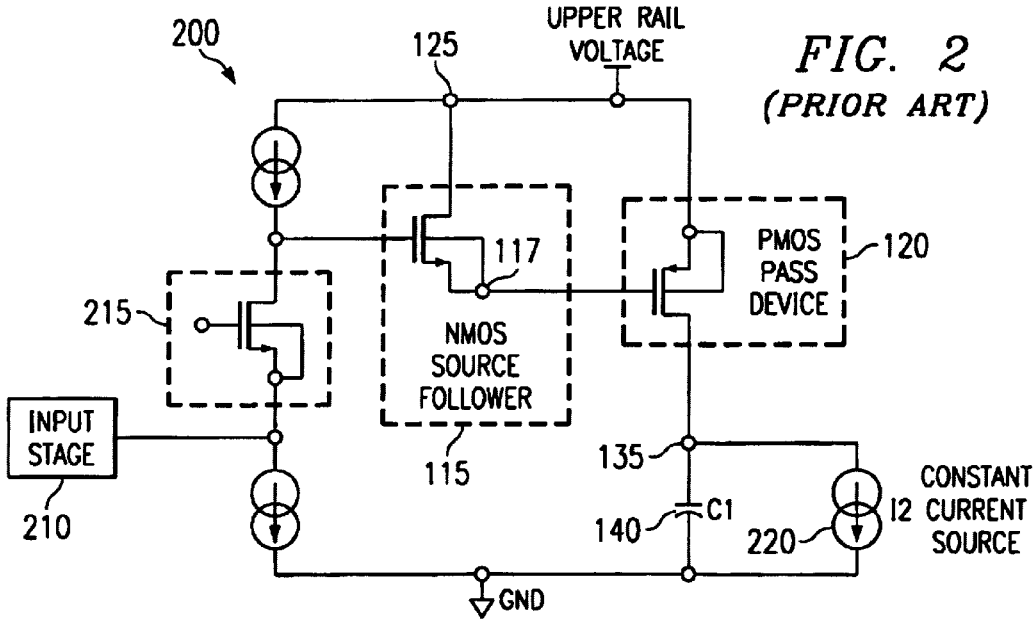
FIG. 2 (PRIOR ART)
FIG. 2 diagrammatically illustrates a PMOS LDO in accordance with the prior art.
Figure 3:
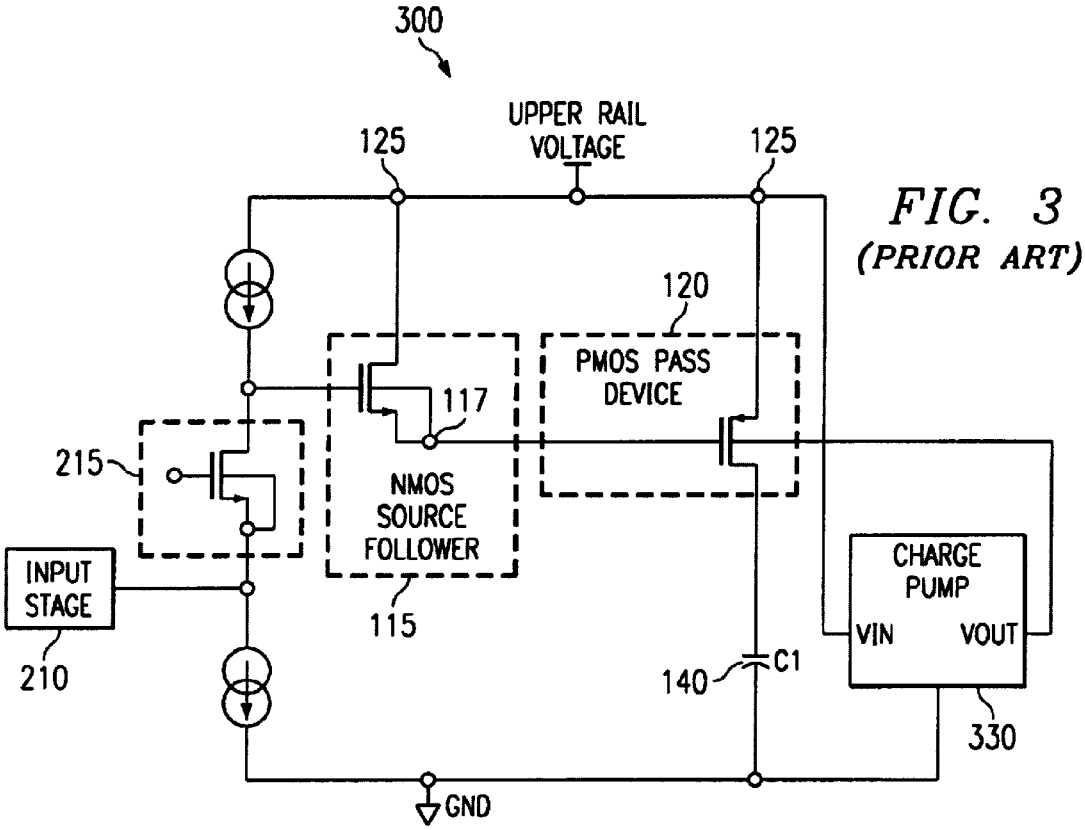
FIG. 3 (PRIOR ART)
FIG. 3 diagrammatically illustrates a PMOS LDO in accordance with the prior art.
Figure 4:
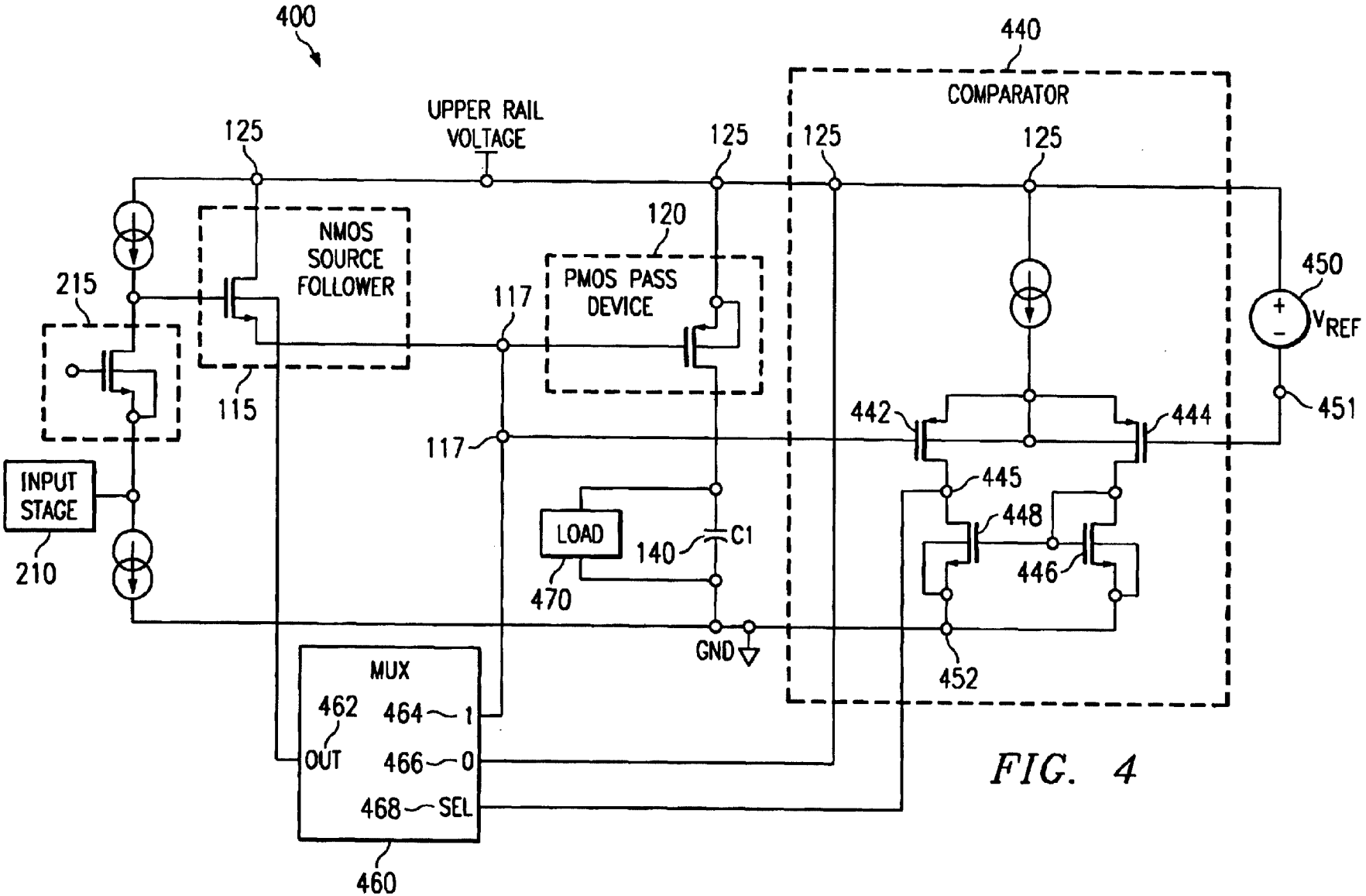
FIG. 4 diagrammatically illustrates a PMOS LDO in accordance with an exemplary embodiment of the present invention.

FIG. 4 diagrammatically illustrates a PMOS LDO 400 in accordance with an exemplary embodiment of the present invention. Input stage 210 and cascoded device 215 drive the gate of NMOS source follower 115. The source of NMOS source follower 115 is tied to node 117. Node 117 is also tied to the gate of PMOS pass device 120. The drain of NMOS source follower 115 and both the source and backgate of PMOS pass device 120 are tied to the upper rail voltage at node 125. Capacitor 140 (C1) is tied from the drain of PMOS pass device 120 to ground. Load 470 is tied across C1 140. The backgate of NMOS source follower 115 is coupled to output 462 (OUT) of MUX 460. MUX 460 could, for example, be a 2:1 multiplexer. First input 464 of MUX 460 is tied to node 117 and second input 466 is tied to the upper rail voltage at node 125. Comparator 440 is tied to node 117, node 125 and, via node 445, to selector bit 468 of MUX 460. Reference voltage source ($V_{ref}$) 450 is coupled between node 125 and comparator 440. At node 451, $V_{ref}$ 450 produces the voltage that has been found to be safe (e.g., upper rail −400 mV) for the forward conduction of the source-bulk junction.

An exemplary embodiment of comparator 440, as shown in FIG. 4, includes four (4) transistors: 442, 444, 446 and 448. The gate of transistor 442 is tied to node 117 and serves as the input of the source voltage of NMOS pass device 115 to comparator 440. The drain of transistor 442 is tied to node 445. Both the sources and backgates of transistors 442 and 444 are tied to node 125. The gate of transistor 444 is coupled to node 451. Both the drain and gate of transistor 446 and the gate of transistor 448 are coupled to the drain of transistor 444. Both the backgates and sources of transistors 446 and 448 are tied to node 452, which runs to ground. The drain of transistor 448 is tied to node 445, thereby coupling its drain to the drain of transistor 442. Node 445 provides the output to set selector bit 468 of MUX 460.

Comparator 440 will determine if the source voltage of NMOS pass device 115 is higher or lower than the voltage at node 451. At node 451, $V_{ref}$450 provides the voltage that has been found to be safe for the forward conduction oft he source-bulk junction. The output of comparator 440 at node 445 is connected to selector bit 468 of MUX 460. Output 462 of MUX 460 will determine the potential applied to the backgate of NMOS source follower 115.

Inputs 464 and 468 of MUX 460 are the source potential of NMOS source follower 115 (same as the gate voltage of PMOS pass device 120) and the upper rail potential at node 125, respectively. During the normal operation of LDO 400, when it is supplying a load current, the source of NMOS pass device 115 will be at a lower voltage than node 451. Therefore, comparator 440 will set selector bit 468 of MUX 460 HIGH, connecting the backgate of NMOS source follower 115 to its own source potential. When there is no load current being supplied, the source voltage of NMOS source follower 115 exceeds node 451. In this case, comparator 440 will set selector bit 468 of MUX 460 LOW, connecting the backgate of NMOS source follower 115 to the upper rail potential at node 125.

Although exemplary embodiments of the present invention have been described in detail, it will be understood by those skilled in the art that various modifications can be made therein without departing from the spirit and scope of the invention as set forth in the appended claims.

What is claimed is:

1. A voltage regulator circuit, comprising:

an input amplifier;

a source follower coupled to an output of said input amplifier;

a pass device coupled to an output of said source follower, said pass device also coupled to a node where voltage is to be regulated;

a compensating capacitor coupled between said node and a first power supply node;

a comparator having a first input coupled to the output of said source follower and a second input coupled to a reference voltage node; and a multiplexer having a first input coupled to the output of said source follower, a second input coupled to a second power supply node and an output coupled to a backgate of said source follower.

2. The voltage regulator circuit of claim 1 wherein said multiplexer also includes a control input coupled to an output of said comparator.

3. The voltage regulator circuit of claim 1 wherein the source follower includes one of a PMOS transistor and an NMOS transistor.

4. The voltage regulator circuit of claim 3 wherein the source follower is an NMOS transistor having a gate coupled to the output of said input amplifier, a drain coupled to said second power supply node, wherein said source follower output includes a source of said NMOS transistor.

5. The voltage regulator circuit of claim 1 wherein the pass device includes one of a PMOS transistor and an NMOS transistor.

6. The voltage regulator circuit of claim 1 including circuitry for providing at the reference voltage node a reference voltage determined based on a characteristic of said source follower.

7. The voltage regulator circuit of claim 6 wherein said characteristic is a diode characteristic of a source-backgate junction of the source follower.

8. A voltage regulator circuit, comprising:

a supply voltage node;

an output voltage node;

a ground node;

an input amplifier having an input and an output;

an NMOS transistor buffer having a source, a backgate, a drain connected to the supply voltage node, and a gate connected to the output of the input amplifier;

a PMOS transistor pass device having a source connected to the supply voltage node, a backgate connected to the supply voltage node, a gate connected to the source of the NMOS transistor buffer, and a drain connected to the output voltage node;

a compensating capacitor connected between the output voltage node and the ground node;

a comparator having a first input connected to the source of the NMOS transistor buffer, a second input connected to a reference voltage node, and an output; and a multiplexer having a first input connected to the source of the NMOS transistor buffer, a second input connected to the supply voltage node, a select input connected to the output of the comparator, and an output connected to the backgate of the NMOS transistor buffer.

9. The voltage regulator circuit of claim 8, wherein the comparator further includes:

a first transistor having a gate connected to the gate of the PMOS pass-transistor device, a source and a backgate connected to the supply voltage node, and a drain connected to the output of the comparator;

a second transistor having a gate, a source and a backgate connected to the supply voltage node, and a drain;

a third transistor having a gate and a drain connected to the drain of the second transistor and a backgate and a source connected to each other; and a fourth transistor having a gate connected to the gate and the drain of the third transistor and to the drain of the second transistor, a backgate and a source connected to the source and the backgate of the third transistor, and a drain connected to the drain of the first transistor at the output of the comparator.

10. An electronic circuit, comprising:

an input stage;

a source follower stage having an input coupled to said input stage, said source follower stage also having an output;

a pass device stage having an input coupled to the output of said source follower stage, and an output coupled to a node where voltage is to be regulated; and a multiplexer having a first input for receiving a control signal indicative of a condition at said node, said multiplexer having a second input coupled to a supply voltage, a third input coupled to the output of said source follower stage, and an output coupled to a backgate of said source follower stage.

11. A method for regulating a voltage output, the method comprising:

providing a current flow capability through a voltage regulator circuit to drive a load, said voltage regulator circuit comprising a source follower stage serially connected to a gate of a pass device stage, the pass device stage controlling the voltage to the load; and responsive to conditions at the load, selectively connecting a supply voltage to a backgate input of said source follower stage to drive said pass device stage to control current to the load.

12. The method of claim 11, wherein said selectively connecting step includes connecting the output of said source follower stage to the,input of said source follower stage when the load is at a normal operating condition.

13. The method of claim 11, including determining a reference voltage and comparing said reference voltage to a voltage at the output of said source follower stage to obtain the conditions at the load.

14. The method of claim 13, wherein the comparing step includes providing a comparator for comparing the output of said source follower stay with said reference voltage.

15. The method of claim 13, wherein said selectively connecting step includes controlling a multiplexer responsive to a result of the comparing step.

16. The method of claim 13, wherein said selectively connecting step includes connecting said supply voltage to the backgate input of said source follower stage when the voltage at the output of said source follower stage exceeds said reference voltage.

17. The method of claim 13, wherein said selectively connecting step includes connecting the output of said source follower stage to the backgate input of said source follower stage when said reference voltage exceeds the voltage at the output of said source follower stage.

18. The method of claim 13, wherein said determining step includes determining the reference voltage based on a characteristic of said source follower stage.

19. The method of claim 18, wherein said characteristic is a diode characteristic of a source-backgate junction of the source follower stage.

20. The method of claim 11, wherein said selectively connecting step includes connecting said supply voltage to the backgate input of said source follower stage when the load is at a no load condition.

* * * * *